US005832838A

United States Patent [19]

Shaw

[11] Patent Number: 5,832,838

[45] Date of Patent: Nov. 10, 1998

[54] FRAME BRACE UNIVERSAL MOUNTING BRACKET ASSEMBLY

[75] Inventor: William B. Shaw, Chicago, Ill.

[73] Assignee: Standard Research and Design Corporation, Park Ridge, Ill.

[21] Appl. No.: 775,871

[22] Filed: Jan. 2, 1997

[51] Int. Cl.[6] ..... B61F 5/52

[52] U.S. Cl. ..... 105/206.2; 105/165; 105/182.1

[58] Field of Search ..... 105/165, 167, 105/168, 182.1, 206.1, 206.2

[56] References Cited

U.S. PATENT DOCUMENTS

| | | | |
|---|---|---|---|
| 569,044 | 10/1896 | Hardie | 105/165 |
| 4,570,544 | 2/1986 | Smith | 105/165 |
| 4,870,914 | 10/1989 | Radwill | 105/206.2 |
| 5,243,920 | 9/1993 | Lamson et al. | 105/165 |
| 5,461,986 | 10/1995 | Sarnicki et al. | 105/165 |
| 5,579,696 | 12/1996 | Berg | 105/182.1 |
| 5,584,250 | 12/1996 | Berg | 105/182.1 |
| 5,609,109 | 3/1997 | Berg | 105/182.1 |

*Primary Examiner*—S. Joseph Morano

*Attorney, Agent, or Firm*—Dorn, McEachran Jambor & Keating

[57] ABSTRACT

A rail car truck side frame for use in a frame brace truck which has stabilizing cross braces extending between the side frames. The side frame has a top compression member and a bottom tension member which are joined by upwardly and outwardly slanted end walls. Each side frame has a pedestal horn spaced from each end wall. There is a bracket assembly at the lower end of each wall for use in mounting a cross brace. Each bracket assembly includes a three-walled channel mounting bracket, with one wall having an opening therein for the mounting of the cross brace. There is a base plate welded to an outboard side of the side frame and having a first portion welded to an upper edge of the channel mounting bracket for providing support therefor. A second portion of the base plate is welded to the side frame pedestal horn. There is a support plate welded to an inboard side of the side frame adjacent its unit guide pocket and welded to the base plate for providing support therefor.

6 Claims, 3 Drawing Sheets

Fig.4.
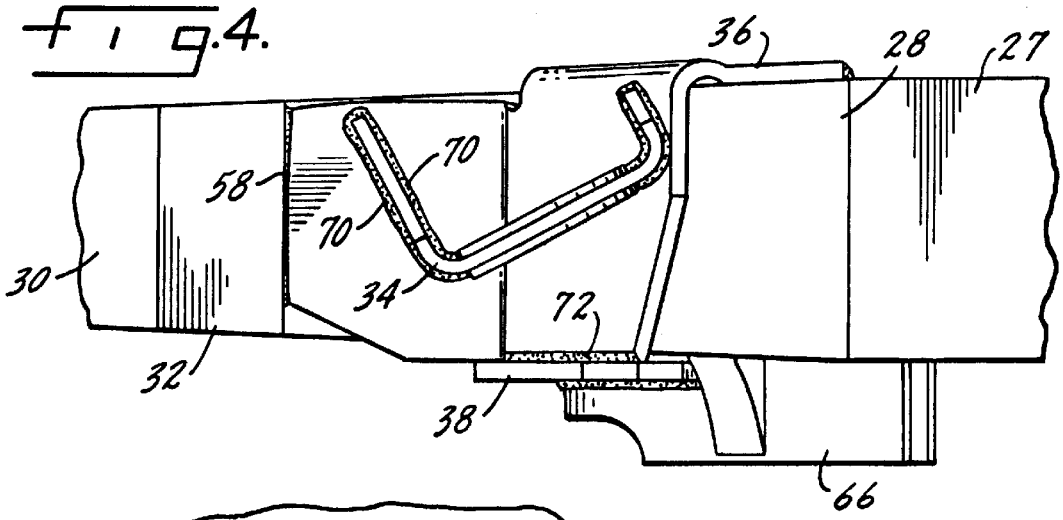
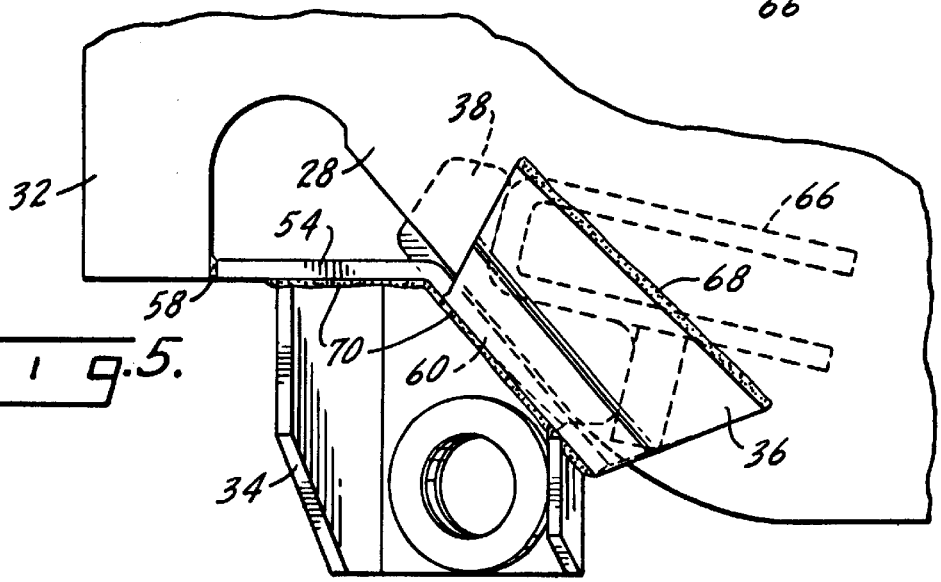
Fig.5.
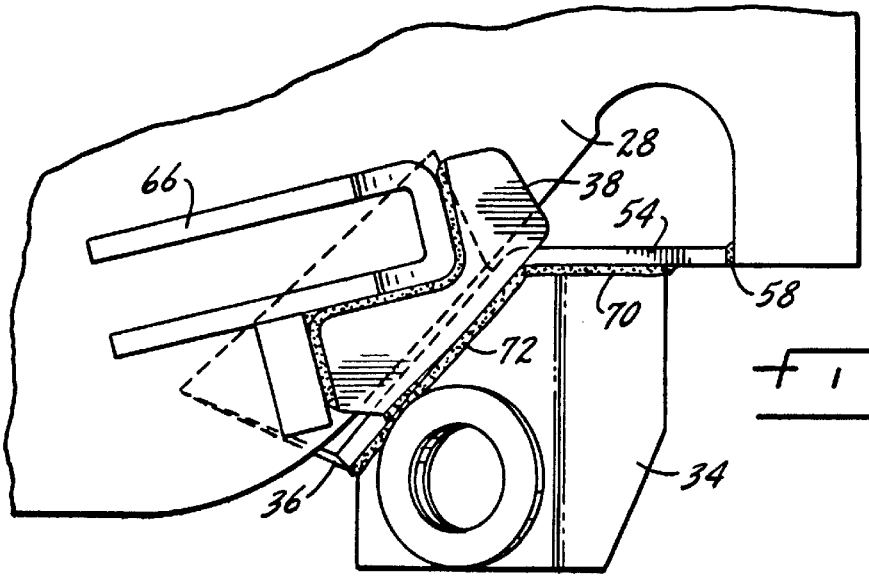
Fig.6.

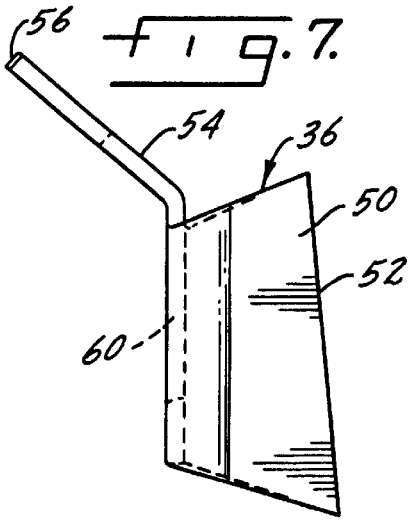
Fig. 7.
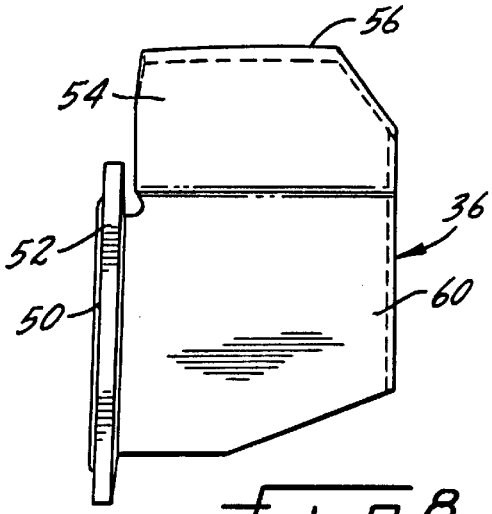
Fig. 8.
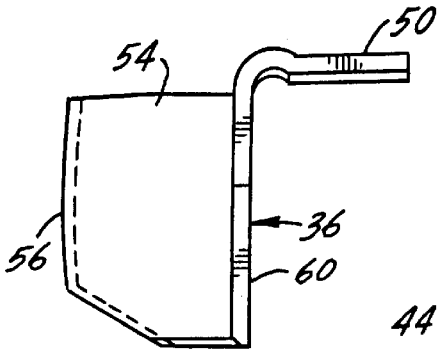
Fig. 9.
Fig. 10.
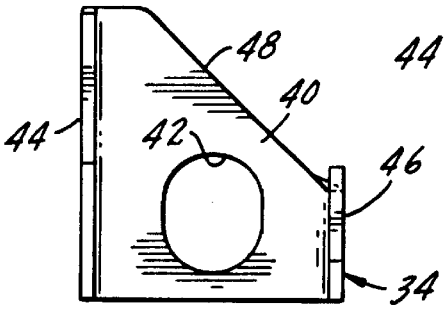
Fig. 11.
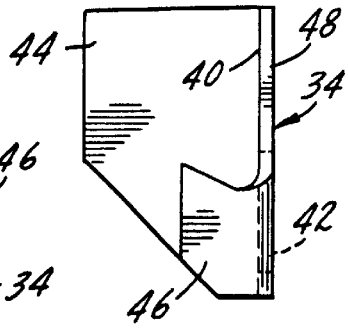
Fig. 12.
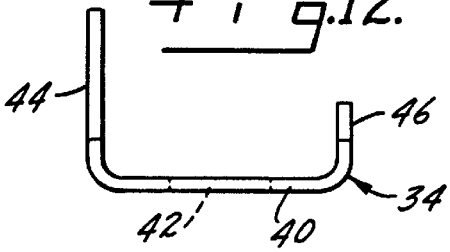
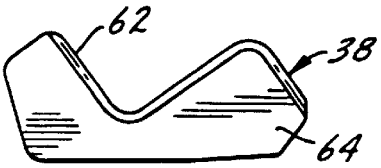
Fig. 13.
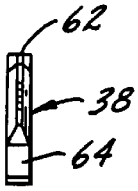
Fig. 14.

FRAME BRACE UNIVERSAL MOUNTING BRACKET ASSEMBLY

THE FIELD OF THE INVENTION

The present invention relates to frame brace rail car trucks of the type described in U. S. Pat. Nos. 570,544, 4,870,914, 5,243,920 and 5,461,986, three of which are assigned to the assignee of the present application, Standard Research and Design Corporation of Park Ridge, Illinois. The disclosure of the '986 patent is specifically incorporated by reference herein, as it shows many of the details of the frame brace truck which are not specifically described and shown in the present specification and drawings.

In the '986 patent there is a U-shaped bracket which is used to support the cross braces or cross struts as they are often termed. This bracket is supported by what is termed a base plate, which is attached to one of the slanted end walls which connect the tension and compression members of a typical side frame. Although side frames are conventional in the sense that in a three-piece truck each has a compression member, a tension member, and slanted end walls which connect them, the angle of the slanted end walls will vary in accordance with the particular manufacturer of the side frame. This creates problems in the construction of a mounting bracket to support the cross braces of a frame brace truck in that each mounting bracket must be specially designed for the specific side frame with which it is to be used. The present invention provides a universal mounting bracket assembly consisting of a channel mounting bracket, a base plate and a support plate, with these elements being so formed and utilized as to mount the channel mounting bracket in the same location regardless of the angle of the slanted end wall which connects the tension and compression members of a typical three-piece truck side frame.

SUMMARY OF THE INVENTION

The present invention relates to frame brace trucks in which a pair of cross struts are used to stabilize the truck and in particular to an improved universal mounting bracket assembly for the cross struts.

A primary purpose of the invention is an improved mounting bracket assembly for the use described which is adapted to fit essentially any configuration of three-piece truck side frame regardless of the angle of the slanted end wall between the tension and compression members.

Another purpose is a mounting bracket assembly for the use described made up of three elements which are interrelated and designed to be attached to the inboard and outboard sides of a side frame and to place the mounting hole for the cross brace in the same location regardless of the specific design of the three-piece truck side frame.

Other purposes will appear in the ensuing specification, drawings and claims.

BRIEF DESCRIPTION OF THE DRAWINGS

The invention is illustrated diagrammatically in the following drawings wherein:

FIG. 4 is a bottom view of the mounting bracket and side frame of FIGS. 2 and 3;

FIG. 5 is an enlarged side view, similar to FIG. 2, but showing the mounting bracket assembly attached to a side frame of different configuration from that of FIG. 2;

FIG. 6 is an inboard view of the side frame, similar to FIG. 3, but showing the mounting bracket assembly on the side frame of FIG. 5;

FIG. 7 is a side view of the base plate;

FIG. 8 is a plan view of the base plate;

FIG. 9 is an end view of the base plate;

FIG. 10 is a side view of the channel mounting bracket;

FIG. 11 is an end view of the channel mounting bracket;

FIG. 12 is a top view of the channel mounting bracket;

FIG. 13 is a side view of the support plate; and

FIG. 14 is an end view of the support plate.

DESCRIPTION OF THE PREFERRED EMBODIMENT

Figure 1:
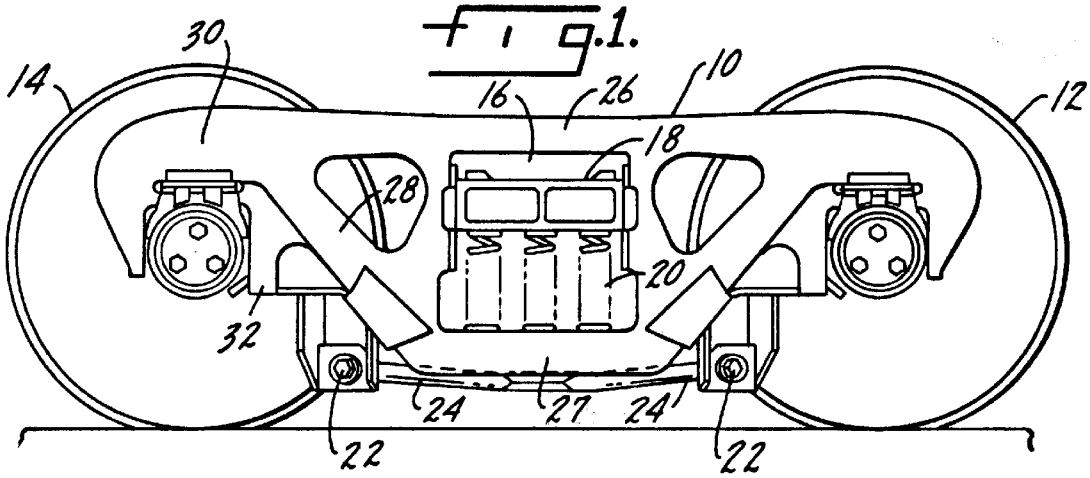
FIG. 1 is a side view of a three-piece freight car truck showing the improved bracket assembly of the present invention.

U.S. Pat. No. 5,461,986, the disclosure of which is incorporated herein by reference, discloses a rail car truck having a pair of side frames supported on conventional longitudinally spaced wheelsets. To improve truck stability, cross braces extend between the side frames to increase the resistance to side frame relative longitudinal movement. U.S. Pat. No. 4,870,914 shows one form of mounting bracket to support the cross brace or strut, with the '986 patent showing an improvement in the bracket.

Although the side frames of three-piece rail car trucks have certain conventional parts, the relationship of these parts is not necessarily standard. All have a top compression member and a bottom tension member and slanted end walls which connect the compression member and the tension member. However, the angle of the slanted end wall may vary, depending upon the particular manufacturer. This requires the design of a special mounting bracket for each design of side frame. The present invention provides a universal mounting bracket assembly suitable for use on any side frame design for a three-piece rail car truck.

In the drawings, a side frame for a conventional threepiece truck is indicated at 10 and is mounted on wheelsets 12 and 14. There is a window 16 in the side frame and mounted therein is a bolster indicated at 18. Spring groups 20 will support the bolster within the window of the side frame. Extending from the underside of the side frame are mounting bracket assemblies 22, each of which will mount the end of a cross brace 24.

Each side frame includes an upper compression member 26 and a lower tension member 27. These members are joined by slanted end walls 28. All three-piece rail car trucks have these three members, however, the angle of the slanted walls 28 may vary depending upon the manufacturer of the side frame. The end of each side frame includes a pedestal 30 which includes a portion thereof termed the pedestal horn indicated at 32. Focusing on FIGS. 2, 3 and 4, each mounting bracket assembly 22 includes three elements, a U-shaped or channel-shaped mounting bracket 34 illustrated in FIGS. 10, 11 and 12; a base plate 36 illustrated in FIGS. 7, 8 and 9; and a support plate 38 illustrated in FIGS. 13 and 14.

Each channel mounting bracket 34 has three walls, a center wall 40 having an opening 42 for the mounting of a cross brace 24; an end wall 44 generally at right angles to the wall 40; and a second end wall 46, shorter than the end wall 44 and also generally at right angles to the wall 40. The center wall 40 has a slanted upper edge 48, which will be described hereafter.

Figure 2:
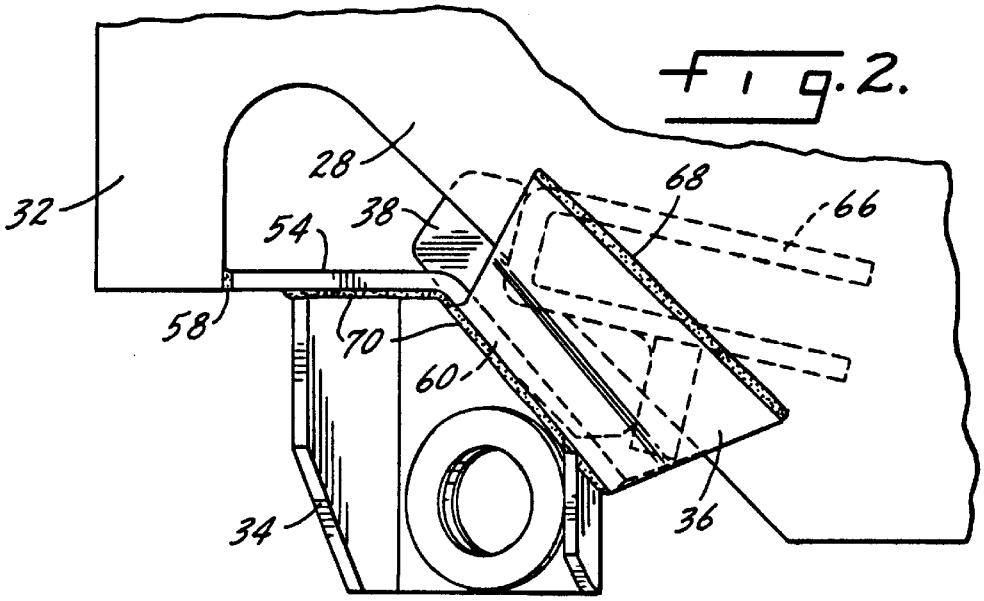
FIG. 2 is an enlarged partial side view of the side frame and mounting bracket taken from the outboard side of the side frame.

Each base plate 36 includes an outer wall 50 having an edge 52, and a projecting wall 54, the outer end of which indicated at 56 will be welded or otherwise attached to the pedestal horn, as shown by the weld 58 in FIGS. 2 and 5. The base plate further includes a support wall 60 to which is attached the support plate.

The support plate includes a somewhat irregular S-shaped edge 62 and a plate portion 64.

Figure 3:
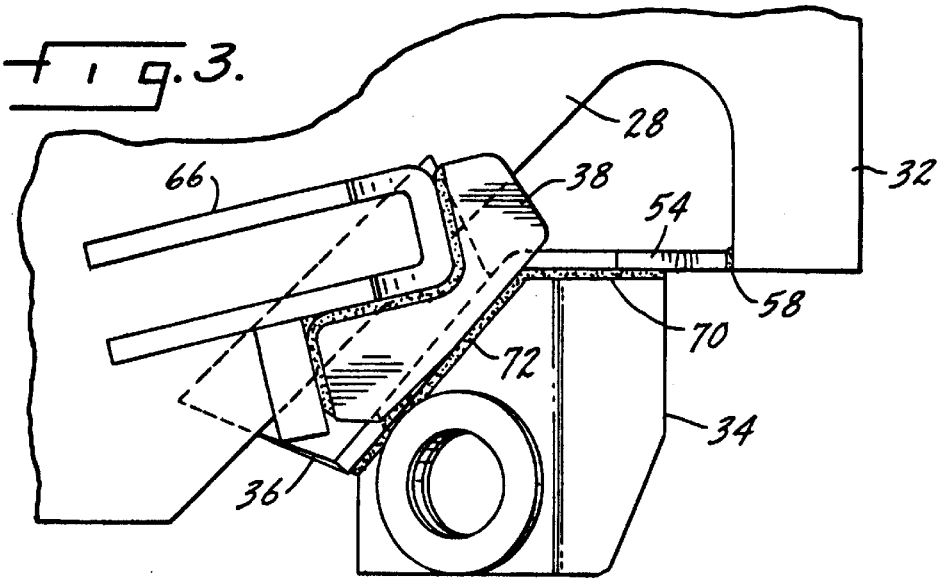
FIG. 3 is an enlarged side view, similar to FIG. 2, but taken from the inboard side of the side frame.

As indicated in FIGS. 2 and 3, the inboard side of each side frame includes a U-shaped unit guide pocket 66. The somewhat S-shaped edge 62 of the support plate 38 is welded to the unit guide pocket, both for the side frame of FIG. 3 and for the side frame configuration shown in FIG. 6. The base plate 36 will have its edge 52 of the outer wall 50 welded, as at 68, to the outboard side of the slanted wall of the side frame. As shown in FIG. 2, the support wall 60 of the base plate 36 is spaced from the slanted end wall 28 of the side frame. This is due to the fact that this particular design of side frame has a steeper angle than the side frame end wall shown in the FIG. 5 and 6 form of side frame. The upper edge 48 of the channel mounting bracket is welded along both sides thereof, as shown at 70 in FIG. 4, to the underside of the support wall 60 of the base plate. As indicated above, the edge 56 of the base plate will be welded to the pedestal horn, as shown at 58. The construction is completed by the weld 72 which connects the support plate 38 to the side of the base plate.

To summarize, in a three-piece freight car truck, although the angle of the slanted end wall connecting the tension and compression members may vary, the location of the unit guide pocket is standard for all side frames and is mandated by the American Association of Railroads regulations. Using this as a guide, the support plate is welded to the unit guide pocket as shown in FIGS. 2, 3, 5 and 6. The support plate in turn is welded to and supports the base plate. The base plate is welded both to the outboard side of the side frame and to the pedestal horn, as shown in FIGS. 2 and 5. The assembly is completed by welding the upper slanted edge 48 of the channel mounting bracket to the underside of the base plate, as shown in FIG. 4.

Of particular advantage in the present invention is the fact that the mounting bracket assembly, including the channel mounting bracket, the support plate and the base plate, are universal in that they will fit essentially any design of side frame for a three-piece rail car truck. The support plate is attached to the unit guide pocket which is standard on all side frames and the remaining members of the assembly will attach to the side frame at locations determined by the slant of the side frame end wall, but in all cases the unit guide pocket is the locator for the bracket mounting assembly so that the opening 42 in the channel mounting bracket will be in a standard position for all frame brace trucks.

Whereas the preferred form of the invention has been shown and described herein, it should be realized that there may be many modifications, substitutions and alterations thereto.

The embodiments of the invention in which an exclusive property or privilege is claimed are defined as follows:

1. A side frame for use in a frame brace truck having stabilizing cross braces extending between side frames, said side frame including a top compression member and a bottom tension member, upwardly and outwardly slanted end walls connecting said compression and tension members, a pedestal horn spaced from each end wall of said side frame, and a bracket assembly at the lower end of each end wall for use in mounting one of said cross braces, each bracket assembly including a three-walled channel mounting bracket with one wall thereof having an opening therein for the mounting of one of said cross braces, a base plate attached to an outboard side of the side frame and having a first portion attached to an upper edge of said channel mounting bracket for providing support therefor, a second portion of said base plate being attached to the side frame pedestal horn, and a support plate attached to an inboard side of said side frame and to said base plate.

2. The side frame of claim 1 including a unit guide pocket on the inboard side of said side frame adjacent each of said slanted end walls, each support plate being attached to one of said unit guide pockets.

3. The side frame of claim 2 wherein each channel mounting bracket has a center wall with the cross brace mounting opening therein and two side walls, with the side walls being generally at 90 degrees to the center wall, the upper edge of each center wall being attached to an underside of the base plate.

4. The side frame of claim 3 wherein the upper edge of each mounting bracket center wall is slanted generally coextensively with the slanted end wall connecting the compression and tension members.

5. The side frame of claim 1 wherein each of the attachments between the channel mounting bracket and the base plate, the channel mounting bracket and the side frame, the support plate and the inboard side of the side frame, and the support plate and the base plate, are formed by welds.

6. A rail car truck including two parallel side frames and a bolster extending therebetween, a pair of struts oppositely inclined to the longitudinal axis of the truck and each extending between the side frames, and means for mounting the ends of said struts including a bracket assembly attached to each of said side frames, each bracket assembly including a three-walled channel mounting bracket with one wall thereof having an opening therein for the mounting of one of said struts, a base plate attached to an outboard side of each side frame and having a first portion attached to an upper edge of said channel mounting bracket for providing support therefor, and a second portion attached to a side frame pedestal horn, and a support plate attached to an inboard side of each side frame and to a respective said base plate.

* * * * *